United States Patent [19]

Hofer et al.

[11] 4,073,275

[45] Feb. 14, 1978

[54] FUEL INJECTION PUMP

[75] Inventors: Gerald Hofer, Weissach-Flacht; Karl Konrath, Ludwigsburg, both of Germany

[73] Assignee: Robert Bosch GmbH, Stuttgart, Germany

[21] Appl. No.: 652,863

[22] Filed: Jan. 27, 1976

[30] Foreign Application Priority Data

Jan. 28, 1975 Germany ..... 2503346

[51] Int. Cl.[2] ..... F02M 59/24

[52] U.S. Cl. ..... 123/139 AF; 123/139 BD; 417/289; 417/304

[58] Field of Search ..... 123/139 AB, 139 AF, 123/139 E, 139 BD, 140 J; 417/289, 304, 490, 494; 251/141

[56] References Cited

U.S. PATENT DOCUMENTS

| | | | |
|---|---|---|---|
| 2,565,681 | 8/1951 | Fleck et al. | 417/494 X |
| 2,794,397 | 6/1957 | Burman | 123/139 BD |
| 3,644,064 | 2/1972 | Eckert et al. | 123/140 FG X |
| 3,677,256 | 7/1972 | Regneault et al. | 123/139 AF X |
| 3,699,939 | 10/1972 | Eckert et al. | 123/140 J |
| 3,779,225 | 12/1973 | Watson et al. | 123/139 E |
| 3,797,235 | 3/1974 | Eheim | 123/139 E X |

FOREIGN PATENT DOCUMENTS

| | | | |
|---|---|---|---|
| 2,018,112 | 12/1970 | Germany | 417/505 |

*Primary Examiner*—Charles J. Myhre
*Assistant Examiner*—Tony M. Argenbright
*Attorney, Agent, or Firm*—Edwin E. Greigg

[57] ABSTRACT

A fuel injection pump for diesel engines has a reciprocating pressure piston which also rotates to distribute fuel to the individual injection valves. At idling and low engine load, the duration of injection is extended by permitting part of the fuel advanced by the piston to flow back to the fuel storage compartment. The fuel control mechanism adjusts the piston stroke to compensate for this lost fuel, thereby extending the duration of injection and reducing engine noise.

8 Claims, 1 Drawing Figure

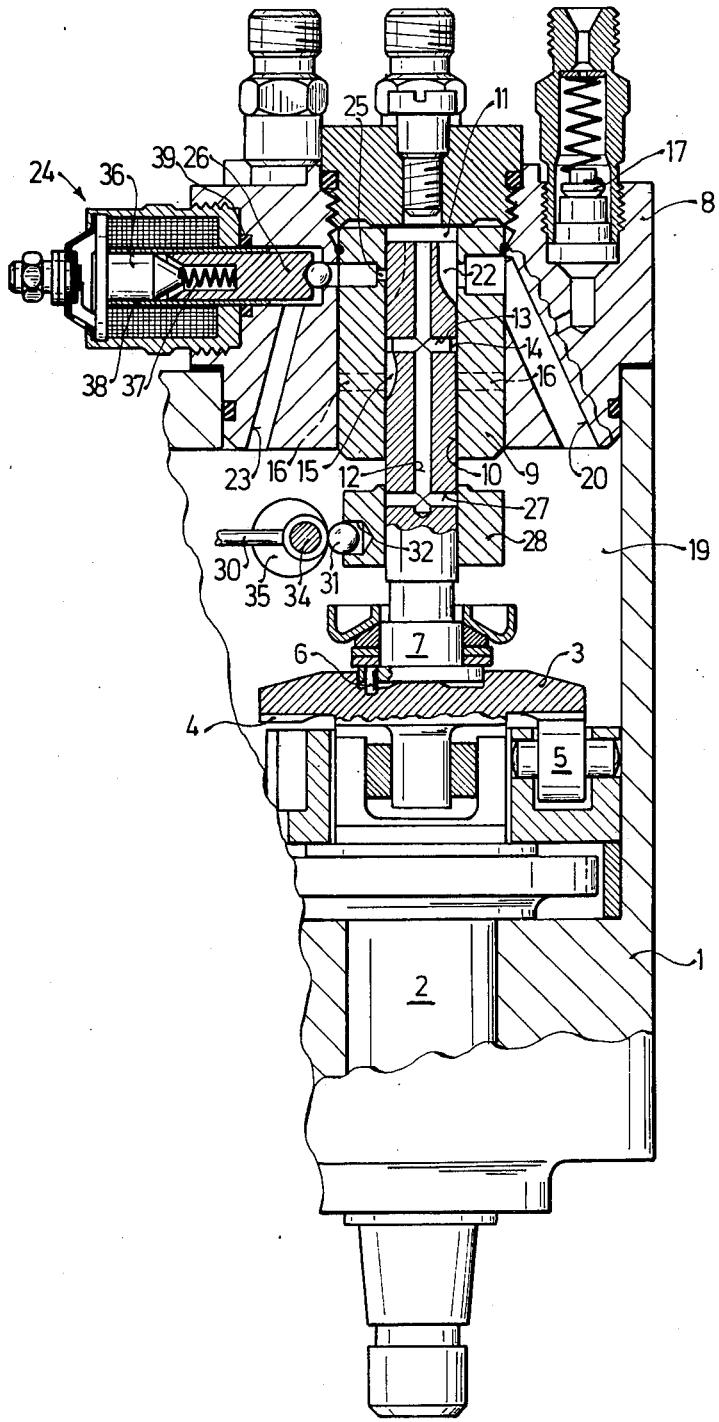
24
36
39
26
25
11
17
8
22
13
14
16
38
37
23
16
15
12
10
9
20
27
28
32
19
30
35
34
31
7
6
3
4
5
1
2

FUEL INJECTION PUMP

BACKGROUND OF THE INVENTION

The invention relates to a fuel injection pump for internal combustion engines including a rotating distributing piston which, during its suction stroke, fills the pump pressure chamber with fuel from a storage compartment. A controlled aperture channel permits removing some of the fuel from the pump working chamber during idling and conditions of reduced engine load.

Most diesel engines produce unpleasantly harsh combustion noises at idling or in the low-load domain. The intensity of these noises may be substantially reduced by prolonging the duration of injection in these rpm regions. In known manner, the injection duration is extended by permitting a portion of the fuel supplied by the fuel pump piston to flow off during the time that the engine operates in this rpm domain. Accordingly, to maintain the engine rpm, this quantity of removed fuel must be replaced, and thus the time during which fuel is supplied is correspondingly extended.

In a known fuel injection pump of the general type described above, the flow control of the efflux channel takes place by means of an annular groove worked into the surface of the fuel pump piston. This annular groove cooperates with a control slide which operates according to the principle of a fluid stop. This known control process, however, may not be applied to commonly used injection pumps because the proper functioning can be guaranteed only when a control slide is present.

In another known fuel injection pump which provides injection time extension during idling by permitting part of the fuel to flow out of the pump's working chamber, the fuel may, in disadvantageous manner, leave the working chamber at the onset of fuel supply. This fact changes the onset of injection and makes the quantity of fuel supplied by the engine incorrect because, even though the efflux is throttled, actual fuel supply to the engine takes place only after sufficient piston pressure has been built up to overcome the opening pressure of the injection valve in the presence of the throttle flow.

OBJECT AND SUMMARY OF THE INVENTION

It is a principal object of the invention to provide a fuel injection pump of the type described above in which the onset of injection is not changed in disadvantageous manner and which provides quiet running control independently of the particular type of fuel quantity regulator used.

This object is achieved according to the invention by providing a fuel injection pump in which the terminus of the efflux channel is controlled by a longitudinal groove in the pump piston and by providing means to insure that the efflux channel is opened only after the pump has built up a pre-defined pressure in its pressure chamber. Those grooves which control the efflux channel are offset with respect to the normal distribution groove so as to insure that the efflux channel is opened only after fuel supplied to the injection valves has actually begun.

An advantageous feature of the invention provides that the throttle of the efflux channel is located at its terminus. This disposition insures that the additional volume formed by supplementary channels and grooves is held to a minimum and, thus, does not have any substantial detrimental effects.

In another feature of the invention, the control member is an electromagnetic valve. This valve is opened only during idling and low engine load, for opening the efflux channel to remove fuel from the pump's pressure chamber.

The invention will be better understood as well as further objects and advantages become apparent from the following detailed description of an exemplary embodiment of the invention taken in conjunction with the drawing.

BRIEF DESCRIPTION OF THE DRAWING

The single FIGURE of the drawing is a partially cross-sectional view of a portion of a fuel pump according to the invention.

DESCRIPTION OF THE PREFERRED EMBODIMENT

Turning now to the single FIGURE, there is shown a portion of a fuel injection pump for a multi-cylinder internal combustion engine including a housing 1 in which is rotatably secured a drive shaft 2 driven by means not shown, to which is coupled a frontal cam plate 3 carrying a plurality of cam lobes 4 which cooperate with locally fixed rollers 5. When the drive shaft 2 rotates, the frontal cam plate 3 also rotates, as does a pump piston 7 which is slidingly connected to the drive shaft by a coupler 6, and which is pressed onto the frontal cam plate by at least one spring (not shown). Thus, the pump piston 7 simultaneously executes rotary and reciprocating motion. The number of cam lobes 4 is equal to the number of engine cylinders and to the number of strokes per shaft revolution.

A portion of the housing 1 is embodied as a distributor head 8. The pump piston 7 moves within a cylindrical bushing 9, closed on top and inserted in the distributor head. The bushing 9 is provided with a cylindrical bore 10 and defines a pressure chamber 11. The pump piston 7 has an axial bore 12 which terminates in the pump pressure chamber 11. Branching off from the axial bore 12 is a radial bore 13 which terminates in an annular groove 14, in turn connected to a longitudinal distribution groove 15. During the rotation of the pump piston, this longitudinal groove 15 establishes individual communication between the pressure chamber 11 and separate individual pressure lines 16 which terminate in the bore 10 and lead to the individual cylinders (not shown) of the internal combustion engine. The pressure lines 16 are distributed uniformly around the bore 10. Each of the pressure lines 16 contains a check valve 17, preferably embodied to serve also as a pressure relief valve. During each compression stroke of the piston 7, a suitable amount of fuel is delivered through the central bore 12, the transverse bore 13, the annular groove 14 and the distribution groove 15 to one of the pressure lines 16. The housing defines a suction chamber 19 containing engine fuel which is kept at slightly elevated pressure. During the suction stroke of the piston 7, fuel flows from the suction chamber 19 via a suction line 20 into the bore 10, admitted by a plurality of longitudinal grooves 22 in the pump piston which permit fuel to flow into the pressure chamber 11. The number of longitudinal grooves 22 is equal to the number of pressure lines 16. The suction conduit 20 and the pressure lines 16 are angularly displaced when, as shown in the exemplary embodiment, the longitudinal distribution groove 15 and at least one of the longitudinal grooves 22 are located in the same plane. Inasmuch as the suction and compression strokes alternate and either the suction line or one of the pressure lines communicates with the pressure chamber, the suction line 20 is disconnected from the longitudinal grooves 22 during the compression stroke of the piston. The pressure chamber 11 and the suction chamber 19 further communicate through an efflux channel 23 whose passage is controlled by an electromagnetic valve 24 and which includes a throttle 25 at its terminus in the bore 10. The efflux channel 23 is opened and closed during the pressure stroke by the longitudinal grooves 22 shortly after the beginning of the pressure stroke and after a certain predetermined fuel pressure has built up in the pressure chamber 11 and the pressure lines 16. The amount of pressure build-up is so chosen that, even after the efflux channel 23 is opened, the pressure decrease is insufficient to cause an interruption of fuel supply to the engine. The efflux channel is opened by the electromagnetic valve 24 only when the engine is idling or operates in the domain of low load. By removing part of the fuel during the compression stroke at low rpm, the injection time for each pressure stroke is substantially prolonged with the consequence that the engine runs substantially quieter. At high rpm and during full load, it is to be preferred to close the efflux channel so as to make available the entire fuel quantity supplied by the pump. The throttling location which is needed in the efflux channel could also be placed at the point where the electromagnetic valve 24 engages the efflux channel 23 by appropriate design of the stroke of the armature and hence of the movable valve member 26 so that, when open, the effective flow cross section acts as a throttle.

In order to regulate the amount of fuel supplied, the pump pressure chamber 11 communicates with the suction chamber 19 through a second transverse bore 27. Cooperating with the transverse bore 27 is a fuel supply regulating member 28 embodied as an annular slide displaceable on the surface of the piston. The position of the annular slide determines the point of time at which the upward motion of the pump piston 7 opens the transverse bore 27 and thus creates a communication between the pressure chamber 11 and the suction chamber 19. From this point on, the supply of fuel to the pressure lines 16 is interrupted. Thus, by appropriate adjustment of the annular slide 28, the amount of fuel delivered to the engine can be changed.

To effect this change, the annular slide 28 is engaged by the spherical head 31 of a control lever 30 which engages a recess 32. The control lever pivots about a point 34 whose position can be changed by an eccentric 35. The other end of the control lever 30 is engaged by a control spring in opposition to the force of an rpm signal generator. The bias tension of the control spring may be adjusted with an arbitrarily settable lever. When the engine rpm increases, the rpm signal generator acts to reduce the injected fuel quantity, whereas the spring urges the lever in the direction of increasing fuel quantity. The equilibrium position which defines the actual injected fuel quantity can be adjusted by the above-mentioned lever.

The electromagnetic valve 24 must be capable of exerting substantial forces because it is required to close the efflux channel 23 during the compression stroke of the injection pump in the range of higher engine rpm. For this reason, the mutually facing ends of the armature 26 and its core 36 are conical. A valve-closing spring 37 is supported on the core 36 and is located in a blind bore of the armature 26. The armature moves in a bushing 38, preferably made from non-magnetic material so as to prevent radial sticking of the armature. The bushing 38 also serves to support a sealing ring 39 between the distributor head 8 and the valve 24. The electromagnetic valve 24 may be threadedly coupled to the distributor head 8 and may be replaced by a plug if its control function is not required.

What is claimed is:

1. In a fuel injection pump including a housing, a fuel storage compartment in said housing, a bushing defining a cylinder, a piston with control grooves moving within said cylinder, shaft means for rotating and reciprocating said piston, said piston and said housing defining a pressure chamber, a channel disposed between said fuel storage compartment and said pressure chamber, and control means for controlling the fuel flow in said channel, the improvement comprising at least one of said control grooves in said piston obturates the terminus of said channel in said cylinder and said control means permits adjustment of the timing of the fuel flow through said channel after said piston has executed a partial compression stroke.

2. A fuel injection pump as defined by claim 1, wherein said channel has a throttle which is located at the terminus of said channel in said cylinder.

3. A fuel injection pump as defined by claim 1, wherein said control means is an electromagnetic valve.

4. A fuel injection pump as defined by claim 1, wherein said channel has a throttle whose aperture is equal to the maximum flow aperture controlled by said control means.

5. A fuel injection pump as defined by claim 3, wherein the armature of said electromagnetic valve is the moving element of said valve and is provided with a spherical tip acting as closure member.

6. A fuel injection pump as defined by claim 3, wherein said electromagnetic valve has a magnetic core provided with a conical end face arranged to cooperate with a complementary formed end face on said armature.

7. A fuel injection pump as defined by claim 3, wherein said electromagnetic valve includes a threaded portion arranged to be received in said housing and wherein said housing further includes a valve seat which cooperates with the electromagnetic valve to thereby control fuel flow through said channel.

8. A fuel injection pump as defined by claim 3, wherein said electromagnetic valve has an extension bushing which penetrates said pump housing when said valve is installed therein, said bushing further serving as a support for a seal means which is arranged to seal said electromagnetic valve relative to an adjacent surface of said housing.

* * * * *